US010369400B2

(12) United States Patent
Pozo

(10) Patent No.: US 10,369,400 B2
(45) Date of Patent: Aug. 6, 2019

(54) WEIGHTED THROWING SLEEVE

(71) Applicant: Jaime Pozo, Miami, FL (US)

(72) Inventor: Jaime Pozo, Miami, FL (US)

( * ) Notice: Subject to any disclaimer, the term of this patent is extended or adjusted under 35 U.S.C. 154(b) by 63 days.

(21) Appl. No.: 15/678,035

(22) Filed: Aug. 15, 2017

(65) Prior Publication Data

US 2018/0043201 A1 Feb. 15, 2018

Related U.S. Application Data

(60) Provisional application No. 62/375,191, filed on Aug. 15, 2016.

(51) Int. Cl.

| | |
|---|---|
| ***A41D 13/08*** | (2006.01) |
| ***A63B 21/00*** | (2006.01) |
| ***A63B 69/00*** | (2006.01) |
| ***A63B 69/38*** | (2006.01) |
| ***A63B 21/065*** | (2006.01) |

(52) U.S. Cl.

CPC ..... *A63B 21/065* (2013.01); *A63B 21/4017* (2015.10); *A41D 13/08* (2013.01); *A63B 21/00061* (2013.01); *A63B 69/002* (2013.01); *A63B 69/004* (2013.01); *A63B 69/0071* (2013.01); *A63B 69/38* (2013.01); *A63B 2069/0008* (2013.01)

(58) Field of Classification Search

CPC ..... A41D 13/08; A63B 21/0004; A63B 21/00058; A63B 21/00061; A63B 21/00065; A63B 21/00069; A63B 21/00072; A63B 21/00076; A63B 21/00185; A63B 21/0608; A63B 21/065; A63B 21/068; A63B 21/08; A63B 21/15; A63B 21/159; A63B 21/4001; A63B 21/4017; A63B 21/4019; A63B 21/4021; A63B 21/4023; A63B 21/4025; A63B 21/4027; A63B 21/4039; A63B 21/4043; A63B 65/00; A63B 65/12; A63B 69/0002; A63B 69/002; A63B 69/004; A63B 69/0057; A63B 69/0059; A63B 69/0071; A63B 69/38; A63B 2069/0004; A63B 2069/0006; A63B 2069/0008; A63B 71/0054; A63B 2071/0072

See application file for complete search history.

(56) References Cited

U.S. PATENT DOCUMENTS 2,241,833 A * 5/1941 Waller ..... A63B 21/065 224/222
3,490,766 A * 1/1970 Gardner ..... A63B 21/0607 273/DIG. 30
3,490,768 A * 1/1970 Archer ..... A63B 21/065 2/159
4,229,833 A * 10/1980 Cox ..... A41D 13/08 2/16

(Continued)

*Primary Examiner* — Gary D Urbiel Goldner
(74) *Attorney, Agent, or Firm* — Christopher J. VanDam; Chris Vandam

(57) ABSTRACT

A weighted throwing sleeve worn by an athlete during practice or training comprised of a sleeve from about the wrist of the wearer to the upper arm. The wrist end has integrated weights. Use of the device during practice can build strength and muscle memory for the more demanding task of throwing with a weighted wrist. During a game and without the sleeve the athlete is able to throw harder, farther and more accurately.

7 Claims, 4 Drawing Sheets

(56) References Cited

U.S. PATENT DOCUMENTS 4,484,740 A * 11/1984 Green ..... A63B 23/03508 482/105
4,556,215 A * 12/1985 Tarbox ..... A63B 21/065 2/161.1
4,575,075 A * 3/1986 Tarbox ..... A63B 21/065 2/161.1
4,684,122 A * 8/1987 Desmond ..... A63B 71/00 482/105
4,756,525 A * 7/1988 Whitsitt ..... A63B 21/065 482/105
4,905,991 A * 3/1990 Alston ..... A63B 21/065 441/59
4,951,317 A * 8/1990 Gray ..... A41D 13/06 2/16
5,638,546 A * 6/1997 Vita ..... A41D 13/08 2/16
6,052,824 A * 4/2000 May ..... A41D 13/08 2/16
6,168,556 B1 * 1/2001 Saavedra ..... A63B 21/4019 224/220
6,554,752 B2 * 4/2003 Cook ..... A63B 21/065 482/105
8,790,224 B1 * 7/2014 Davis ..... A63B 21/0084 441/50
8,876,667 B2 * 11/2014 Russotti ..... A63B 21/0607 482/44
9,861,851 B1 * 1/2018 Owens ..... A63B 21/065
2008/0096696 A1 * 4/2008 Comello ..... A63B 23/1281 473/458
2015/0335977 A1 * 11/2015 D'Orazio ..... A63B 69/002 473/438
2015/0343287 A1 * 12/2015 Stover ..... A63B 69/0002 473/458
2016/0206941 A1 * 7/2016 Voelkel ..... A63B 69/0002

* cited by examiner

WEIGHTED THROWING SLEEVE

U.S. provisional patent application Ser. No. 62/375,191 filed on 15 Aug. 2017 and titled "Weighted Throwing Sleeve", is hereby adopted in its entirety and incorporated herein by reference.

BACKGROUND OF THE INVENTION

1. Field of the Invention

The present invention relates to athletic training, and more particularly, to a weighted throwing sleeve for training use in throwing sports.

2. Description of the Related Art

Several designs for weighted throwing training devices have been designed in the past. None of them, however, includes a sleeve worn on the throwing arm of an athlete with preselected weights in the distal end of a form fitting sleeve.

Applicant believes that the closest reference corresponds to commonly available weighted balls. Typically, these weighted balls are significantly heavier and sometimes larger than the actual game ball. However, it differs from the present invention because when using the present invention a normal game-size and weight ball is used. This allows the athlete to have a training experience more like actual game play than with a modified practice ball.

Other patents and prior art provide for a number of more or less complicated features that fail to solve the problem in an efficient and economical way. None of these patents suggest the novel features of the present invention.

SUMMARY OF THE INVENTION

It is one of the main objects of the present invention to provide an easy to use throwing aid for a variety of sports that use arm movements in play.

It is another object of this invention to provide a device to strengthen an athlete's throwing arm while using a regulation play size and weight ball.

It is still another object of the present invention to provide an adaptable device that can have an appropriate wrist weight for the particular athlete and their level of training.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
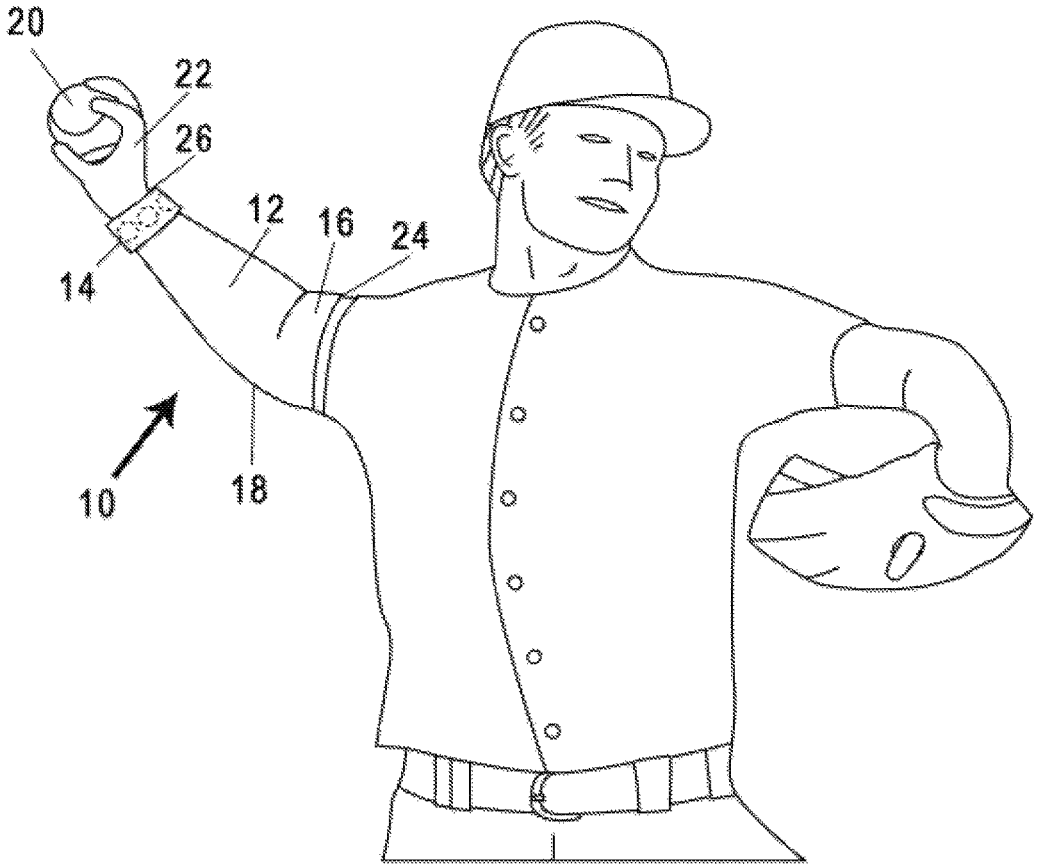
FIG. 1 shows an elevation view of a person wearing a version of a weighted throwing sleeve.

The subject device and method of use is sometimes referred to as the device, the invention, the sleeve, the weighted throwing sleeve, machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes a forearm 12, a wrist 14, an upper 16, an elbow 18, a ball 20, a hand 22, an edge 24, an edge 26, weights 28 and a seam 30.

Figure 2:
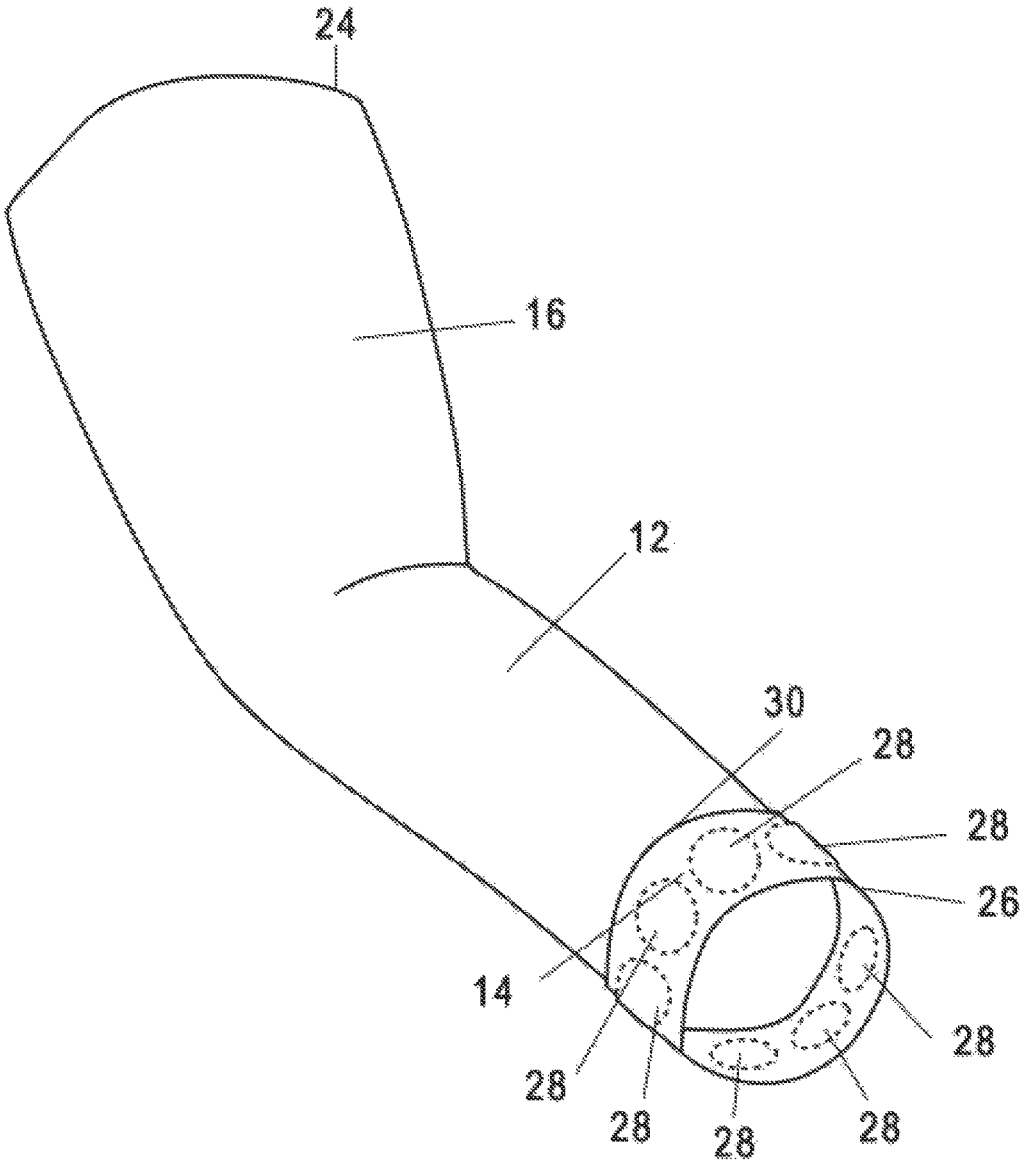
FIG. 2 shows a perspective view of a weighted throwing sleeve.
Figure 3:
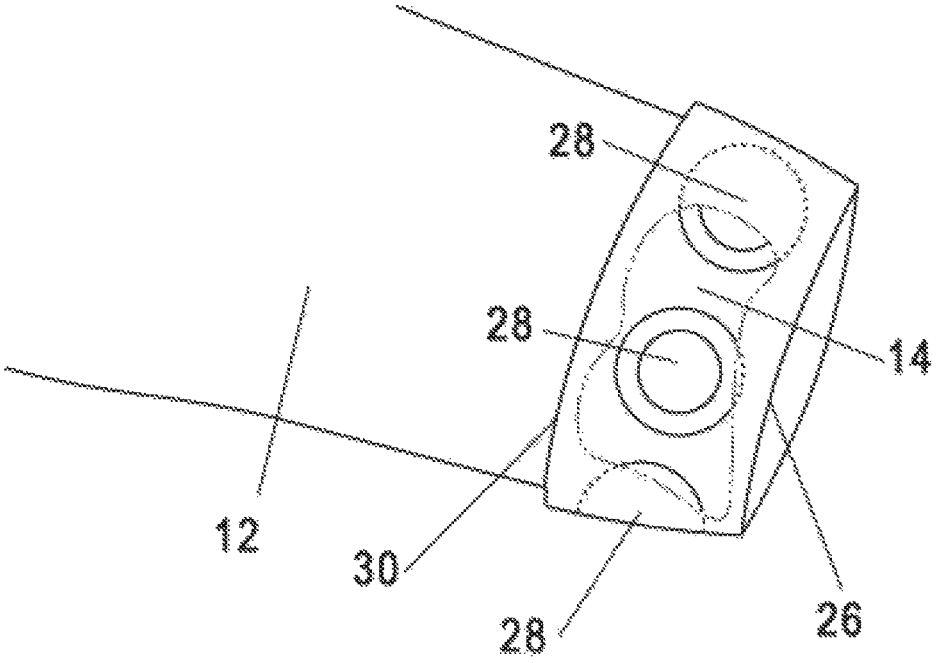
FIG. 3 shows perspective partial cross section of a portion of a throwing sleeve.

FIGS. 1, 2 and 3 show a similar weighted training sleeve with features demonstrative of an effective version of the device. As is typical in training for baseball or other sports, an athlete grips a ball 20 with their hand 22 to throw the ball. Repeated throwing in practice prepares the athlete's body and mind to more effectively throw the ball when the pressure is on during a game.

In the past, weighted balls have been used to strengthen a players arm and get them used to propelling a heavy ball. When that same player then enters the game and a regulation size ball is used, it is comparatively easier for the player to throw the ball. A similar technique is used in baseball with a weighted bat being used while a batter is on deck doing practice swings. When at bat a moment later the regular bat used feels light and efficient to the batter.

A couple of problems arise with the prior art described above. If an athlete practices with a differently weighted or sized ball during practice than is used in the game, the athlete can lose some accuracy and control by switching to a different ball. It is more effective to maintain fine motor control by practicing and playing the game with a ball having equal weight and size.

Also, balls tend to wear out and are frequently lost or stolen. A specialized, heavy practice ball is more expensive than a regulation size practice ball. A team having many players and practice balls could have a significant added expense.

Further, even if a weighted ball has some advantages for throwing they cannot be used for batting practice. Therefore, in a situation like a practice scrimmage or fielding practice with batter hit balls will not be as effective even if possible.

And, the weighted ball could only aid the thrower while causing unnecessary risk to someone catching or fielding. A heavier ball than normal (or expected) can injure a player catching the ball or inadvertently struck with such a ball.

Yet another problem is that weighted balls are not adjustable in weight. It is a one size (weight) fits all sort of device. Younger players, smaller players or injured players might want to have a lower weight option. As a player gains strength through training it can be useful to increase the weight incrementally similar to how weight room training uses increasingly heavier weights as the athlete gets stronger over time to maintain the needed inertial resistance.

A version of a weighted throwing sleeve has a generally tubular shape. It has an edge 24 that when worn by an athlete encircles the upper arm. The upper 16 covers the upper arm of the athlete. The elbow 18 of the sleeve covers the elbow of the wearer and the forearm 12 covers the forearm of the wearer. The sleeve terminates at a distal side away from the shoulder in an edge 26 at about the athlete's wrist. Near the edge 26 is the wrist 14 of the sleeve.

Looking closer at the wrist 14 as seen more clearly in FIGS. 2 and 3, one or more weights 28 are integrated into the wrist 14. The wrist 14 is generally bounded by the edge 26 on the distal end and the seam 30 on the medial side. The weights 28 may be coin shaped as seen in the drawings and are equally effective if in other shapes such as bars, bands, spheres or other shapes. It is preferred that the weights 28 be low profile so as to not interfere with the athlete's motions when throwing a ball.

The weights 28 are effective when made of a dense material to reduce the overall size of the weights 28. Metal, such as lead, steel or other alloys that have characteristics that allow the sleeve to perform well for many sized players and sports may be used for the weights 28.

The weights 28, in one version, are sewn into the wrist 14 so that they cannot separate from the sleeve during normal use in practice. It may be useful to secure the weights 28 in the wrist 14 area at equal spacing around the wrist 14 to maintain balance. The wrist 14 may be comprised of folded over fabric so that the weights 28 are not seen and are protected inside the wrist 14.

The weighted throwing sleeve can be supplied to the end user configured with weights 28 of a specific weight or weights 28 can be added or subtracted to get the most effective weight for a particular athlete. Generally, cumulative weight of the weights 28 is between about thirty grams to about a kilogram. However, depending on the size and strength of the athlete, as well as the nature of training and type of object thrown, the weight could vary as desired. The weight selected is often guided by the amount of inertial resistance that is safe for the athlete and also provides some strengthening, therapeutic or other suitable training benefit for practice or competitive play.

The material from which the forearm 12 and upper 16 are constructed from should be flexible and durable. The material is preferably, but not always necessarily, a stretchable fabric such as spandex or elastane. Other flexible and stretchable materials could also be effectively employed as a primary material for the forearm 12 and upper 16. The material should be comfortable for the athlete to wear for periods necessary for complete training or practice. A breathable material also provides some comfort and performance benefits.

To use the weighted throwing sleeve the athlete selects the appropriate weight of the weights 28. The weight can depend on the strength of the athlete and the training parameters. The weight should not be so much as to risk damage to the anatomy of the athlete or interfere with athletic performance. The athlete then dons the device by placing their throwing hand through the edge 24 of the upper 16 and out the edge 26 of the forearm 12. The edge 24 is then pulled up over the upper arm of the athlete. The distance between the edge 24 and edge 26 is sufficient so that when the edge 26 is at the athlete's wrist and the edge 24 is pulled onto the athlete's upper arm there are few wrinkles or overlaps of the fabric. In other words, the sleeve is generally tight against the arm of the athlete. A shirt may be worn over or under the sleeve.

An athlete may typically wear the weighted sleeve during practice or training. The added weight near the wrist has a similar effect to weight room training with the added benefit that the athlete is doing the exact same motion of throwing as would be done during competition. While weight room training will benefit an athlete it is no specific to the actual motions a player will perform during a match.

When a player repeatedly wears the device during practice they can develop a feel for throwing a regulation sized and weighted ball with a heavier wrist. The player will build up strength and be able to eventually throw the ball with the sleeve on accurately and forcefully. Then, when the sleeve is removed during gameplay, the player will be able to easily throw harder and more accurately. This effectively increases the overall performance of the player.

Over the course of several training sessions with the sleeve the athlete may gradually increase the weight in the sleeve. This can be done by adding more weight to the wrist 14 or simply trading out the lighter wrist device with a heavier wrist device. For some situations, such as for an injury or for cooling down, the weights can be gradually reduced between throws.

Figure 4:
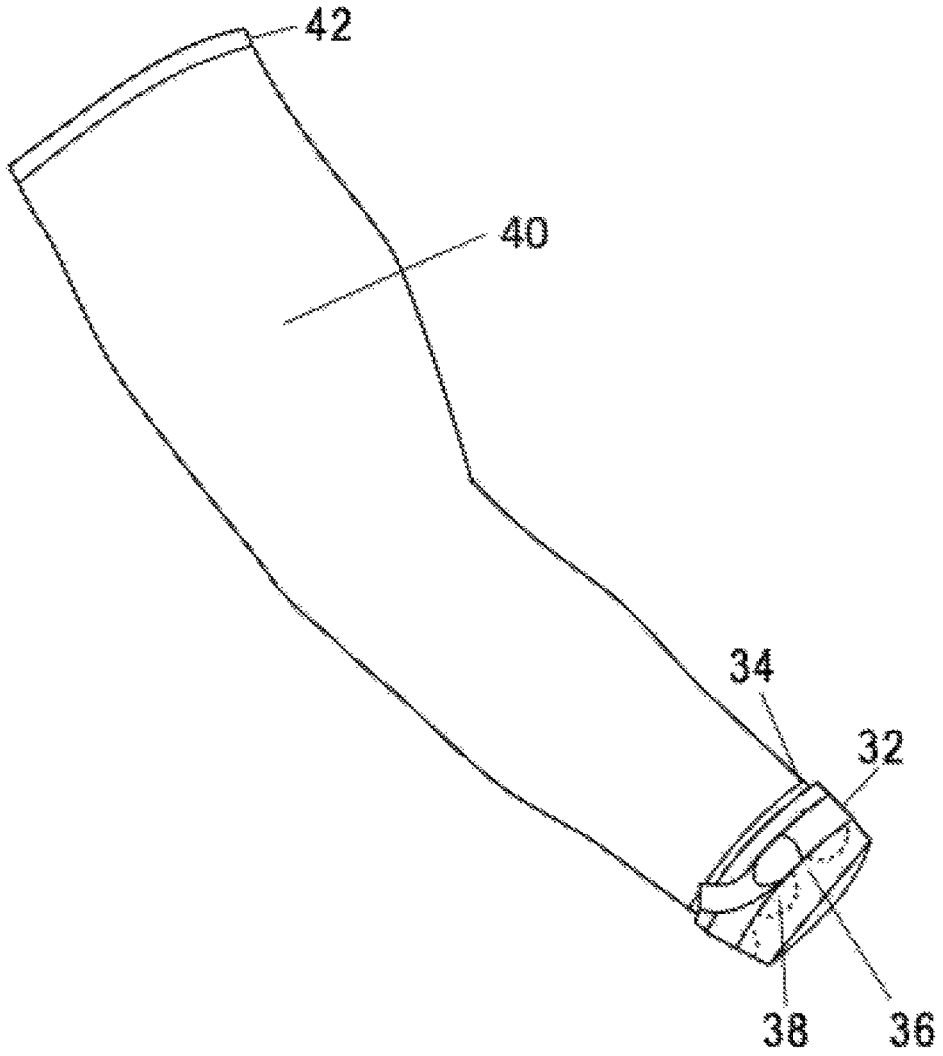
FIG. 4 is shows a perspective view of a weighted throwing sleeve.

Referring now to FIG. 4 where some optional and alternate elements of the general design and shown and include, among other features, a cinch 32, a pocket 34, a wrist 36, weights 38, an upper 40 and a band 42. Any of the features on the several variations shown and described may be mixed and matched with others while remaining within the scope of the inventive concept.

The cinch 32 is provided near the distal end of the device to hold the weights 38 and wrist 36 in place on the athlete's wrist. A similar cinch may also be on the medial edge of the sleeve to hold the upper 40 onto the athlete's arm. Similarly, a band 42 may be at the medial side (as shown in FIG. 4) or the lateral side (in place of or in addition to the cinch 32) to hold the sleeve onto the athlete during vigorous use.

Integrated into the wrist 36 section may be one or more pockets 34 that are dimensioned and adapted to hold weights 38 securely. This allows a wearer to easily change the overall weight of the weights 38. The pockets 34 may have a flap or closure to secure the weights within and prevent them from coming free from the wrist 36 during activity when they should remain securely in place.

A version of the invention can be fairly described as a weighted throwing sleeve for athletic throwing training applied to one arm of an athlete comprised of a sleeve having a medial end nearer the players shoulder and a distal end nearer the players wrist. The sleeve entirely surrounds an arm of the athlete from the medial end of the sleeve to the distal end of the sleeve when worn by the athlete. The medial end of the sleeve is dimensioned to terminate on an upper arm of the athlete and hold itself in place during practice and play. The distal end of the sleeve is dimensioned to terminate on a wrist the athlete and also to remain in place without slippage. A weight is integrated into the distal end of the sleeve. There may be one or more weights configured on or around the wrist. the sleeve is flexible and fits tightly onto the athlete's arm similar to a compression sleeve so that it does not interfere with throwing or other clothing. In at least one version the weight is replaceable for heavier or lighter weights. Utilizing the device, there is a method of throwing training where the device is worn by the athlete during a practice and is not worn subsequently while throwing during a competitive play.

An important version of the invention can fairly be described as a weighted throwing sleeve for athletic throwing training applied to one arm of an athlete comprised of, among other features, a sleeve having a proximal end and a distal end. The sleeve entirely surrounds an arm of the athlete from the proximal end of the sleeve to the distal end of the sleeve but may have an opening, for example for ventilation, exposing the elbow or other part of the arm or finger holes. The proximal end of the sleeve is dimensioned to terminate on an upper arm of the athlete, generally along the humerus bone. The distal end of the sleeve is dimensioned to terminate on or near the wrist the athlete wearing it. A weight is integrated into the distal end of the sleeve, near the wrist area. The sleeve is flexible and fits tightly onto the athlete's arm so it doesnt sag or slip on the athlete's arm during use.

The weighted throwing sleeve may also include a feature where the weight is replaceable for heavier or lighter weights. This allows an athlete to use only one sleeve and adjust it with differing weights for different training activities or as the athlete changes strength or ability. In this sense the device is adaptable. The weights might be in pockets or other attachments so they are easily replaceable. In most uses the weight is between one and eighty ounces, but can vary depending on results from routine testing and trainer recommendations.

The invention also incorporates a method of athletic training where the device disclosed herein is worn by the athlete during a practice and is not worn subsequently while throwing during a competitive play. Strength is gained during training and then with the device off, performance is enhanced.

For specific sport training weights can be different. Heavier or lighter weights may be more suitable to certain sporing activities. By way of example, the net weight may be between five and eighty ounces for baseball batting training, between one and eight ounces for baseball throwing training, between three and thirty-six ounces for basketball training, between twenty and eight ounces for boxing training, between one and five ounces for tennis training and between two and sixteen ounces for football training.

A variation of the device may be fairly characterized as being a weighted throwing sleeve for athletic throwing training applied to one arm of an athlete comprised of a sleeve having a proximal end and a distal end. The sleeve surrounds an arm of the athlete from the proximal end of the sleeve to the distal end of the sleeve. The proximal end of the sleeve is dimensioned to terminate on an upper arm of the athlete at an elastic band or hem to hold it onto the arm better during use. The distal end of the sleeve is dimensioned to terminate on a wrist the athlete with a cinch strap. A weight is integrated into the distal end of the sleeve. The sleeve is flexible and fits tightly onto the athlete's arm.

Another version of the invention may be fairly characterized as a weighted throwing sleeve for athletic throwing training applied to one arm of an athlete comprised of a sleeve having a proximal end and a distal end. The sleeve surrounds an arm section distal to an elbow of the athlete at the proximal end of the sleeve to at or about the wrist of the athlete at the distal end of the sleeve. Part of the wrist may be covered or it may clear the wrist bones entirely. Preferably it does not interfere with free movement of the athlete's hand. The proximal end of the sleeve is dimensioned to terminate distal to the elbow of the athlete at an elastic band to hold the sleeve on the arm without slipping. The distal end of the sleeve is dimensioned to terminate on a wrist the athlete with a cinch strap over the weights to keep the weights firmly in place. The weight is integrated into the distal end of the sleeve and may be removable. The sleeve is flexible and fits tightly onto the athlete's arm. The sleeve is constructed of multiple layers to stiffen the sleeve preventing bunching on the arm section. This makes the device flexible but not so much as to bunch and wrinkle during use so it stays in place on the arm.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A method of athletic throwing training, the method comprising:

applying a weighted throwing sleeve for athletic throwing training to one arm of an athlete such that the weighted throwing sleeve extends from an upper portion of the one arm of the athlete distally to a wrist of the one arm of the athlete, wherein the upper portion is above an elbow of the one arm of the athlete;

the weighted throwing sleeve comprising: a sleeve having a proximal end and a distal end, wherein the sleeve is configured to entirely surround the one arm of the athlete from the proximal end of the sleeve to the distal end of the sleeve; the proximal end of the sleeve being configured to be dimensioned to terminate on the upper portion of the one arm of the athlete; the distal end of the sleeve being configured to be dimensioned to terminate on the wrist of the one arm of the athlete; a weight integrated into the distal end of the sleeve; wherein the sleeve is flexible and is configured to fit tightly onto the one arm of the athlete;

the athlete wears the weighted throwing sleeve while throwing during a practice; and the athlete does not wear the weighted throwing sleeve while throwing during a competitive play subsequent to the practice.

2. The method of athletic throwing training in claim 1, wherein the weight is between five and eighty ounces for baseball batting training.

3. The method of athletic throwing training in claim 1, wherein the weight is between one and eight ounces for baseball throwing training.

4. The method of athletic throwing training in claim 1, wherein the weight is between three and thirty-six ounces for basketball training.

5. The method of athletic throwing training in claim 1, wherein the weight is between twenty and eight ounces for boxing training.

6. The method of athletic throwing training in claim 1, wherein the weight is between one and five ounces for tennis training.

7. The method of athletic throwing training in claim 1, wherein the weight is between two and sixteen ounces for football training.

* * * * *